US008333613B2

(12) United States Patent
De Chazal et al.

(10) Patent No.: US 8,333,613 B2
(45) Date of Patent: Dec. 18, 2012

(54) HEADER ASSEMBLY

(75) Inventors: Aaron James De Chazal, Rochester, MI (US); Adam Price Tyler, Rochester Hills, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/027,981

(22) Filed: Feb. 15, 2011

(65) Prior Publication Data

US 2012/0208400 A1 Aug. 16, 2012

(51) Int. Cl.
*H01R 13/648* (2006.01)

(52) U.S. Cl. ..... 439/607.01

(58) Field of Classification Search ..... 439/607.01–607.59, 354, 357
See application file for complete search history.

(56) References Cited

U.S. PATENT DOCUMENTS

| | | | | |
|---|---|---|---|---|
| 3,977,750 | A | 8/1976 | Glover et al. | |
| 5,387,130 | A | 2/1995 | Fedder et al. | |
| 6,089,896 | A * | 7/2000 | Kosmala | 439/329 |
| 6,341,986 | B1 | 1/2002 | Ko | |
| 6,840,789 | B2 * | 1/2005 | Shibata | 439/345 |
| 6,887,106 | B2 * | 5/2005 | Noguchi et al. | 439/607.56 |
| 7,419,397 | B2 | 9/2008 | Casperson et al. | |
| 7,588,461 | B2 * | 9/2009 | Tyler | 439/607.41 |
| 7,632,145 | B1 * | 12/2009 | Lin et al. | 439/607.32 |
| 7,753,733 | B2 * | 7/2010 | Kameyama et al. | 439/607.35 |
| 2003/0060084 | A1 * | 3/2003 | Aoki | 439/610 |
| 2005/0032404 | A1 | 2/2005 | Furuta et al. | |
| 2006/0025004 | A1 * | 2/2006 | Chen | 439/354 |

FOREIGN PATENT DOCUMENTS

| | | | |
|---|---|---|---|
| EP | 0 560 648 | A1 | 9/1993 |
| EP | 2 190 075 | | 5/2010 |
| GB | 2 276 284 | A | 9/1994 |
| WO | 2007/006335 | A1 | 1/2007 |

OTHER PUBLICATIONS

International Search Report, International Applicaiton No., PCT US2012/000089, International Filing Date, Feb. 15, 2012.

* cited by examiner

*Primary Examiner* — Gary F. Paumen

(57) ABSTRACT

A header assembly is provided that includes an outer housing that has a mating end and a harness end. The outer housing has a cavity at the mating end and a flange configured to be mounted to a panel of a device. The outer housing is configured to be exposed to an exterior of the device for mating with a plug assembly. A shield is received in the cavity that has a front and a rear. An inner housing is received in the cavity with the shield surrounding at least a portion of the inner housing. The inner housing has a front and a rear and has a latch engaging the front of the shield. The latch allows the inner housing to be released from the shield to remove the inner housing from the cavity.

21 Claims, 4 Drawing Sheets

HEADER ASSEMBLY

BACKGROUND OF THE INVENTION

The subject matter herein relates generally to header assemblies, and more particularly, to device mounted header assemblies.

Increased fuel costs and increased efforts at reducing environmental pollution have lead the automotive industry towards electric and hybrid electric vehicles (HEV). One design aspect of these vehicles is the consideration for the high operating voltage. Consequently, specific components of the vehicles must be designed to accommodate the high voltage. The electrical systems of these vehicles include components that operate at high voltages and require high voltage pathways including connectors. For example, some known electrical vehicular systems include components that operate using up to and beyond 600 volts.

In some current automotive industry applications, high voltage shielded connector assemblies are used to provide a stable, sealed mechanical and electrical connection between a high voltage plug assembly and a header assembly mounted to an electronic device in a vehicle, such as a heating or air conditioning unit. The assemblies may need to provide robust shielding continuity between the assemblies and/or other components in the device. The devices typically house one or more electrical components therein that are supplied power by the connector assemblies. The electrical components are electrically connected to the header assembly by a harness assembly.

Known power supply systems for high voltage automotive applications are not without disadvantages. For instance, the devices typically include a small mounting opening through which the harness assembly is fed and then the header assembly is mounted. Because of the electrical components in the device housing, the size of the harness assembly and different types of components of the harness assembly, such as connectors, body clips and the like, feeding the harness assembly through the mounting opening may be difficult and time consuming.

A need remains for a header assembly and harness assembly that may be mounted to a device in a cost effective and reliable manner. A need remains for a header assembly and harness assembly that may be mounted to a device from inside the device.

BRIEF DESCRIPTION OF THE INVENTION

In one embodiment, a header assembly is provided including an outer housing that has a mating end and a harness end. The outer housing has a cavity at the mating end and a flange configured to be mounted to a panel of a device. The outer housing is configured to be exposed to an exterior of the device for mating with a plug assembly. A shield is received in the cavity that has a front and a rear. An inner housing is received in the cavity with the shield surrounding at least a portion of the inner housing. The inner housing has a front and a rear and has a latch engaging the front of the shield. The latch allows the inner housing to be released from the shield to remove the inner housing from the cavity.

In another embodiment, a connector system is provided including a header assembly having an outer housing that has a cavity. A shield is received in the cavity and an inner housing is received in the cavity with the shield surrounding at least a portion of the inner housing. The outer housing has a mating end and a harness end. The shield has a front and a rear. The inner housing has a front and a rear and an inner cavity at the front of the inner housing. The inner housing has a latch that engages the front of the shield. The latch allows the inner housing to be released from the shield to remove the inner housing from the cavity. A plug assembly is received in the cavity of the outer housing. The plug assembly has a plug end received in the inner housing. The plug end blocks actuation of the latch when received in the inner cavity.

In a further embodiment, a family of header assemblies is provided including at least a first header assembly and a second header assembly. The first header assembly includes a first outer housing that has a cavity. A first shield is received in the cavity and a first inner housing is received in the cavity with the first shield surrounding at least a portion of the first inner housing. The first inner housing has a latch engaging the front of the shield. The latch allows the first inner housing to be released from the first shield to remove the first inner housing from the cavity of the first outer housing. The first outer housing has first plug keys configured for mating with a first type of plug assembly. The first outer housing has first inner housing keys configured to cooperate with keys of the first inner housing for orienting the first inner housing with respect to the first outer housing.

The second header assembly includes a second outer housing that has a cavity. A second shield is received in the cavity of the second outer housing and a second inner housing is received in the cavity of the second outer housing with the second shield surrounding at least a portion of the second inner housing. The second inner housing has a latch engaging the front of the shield. The latch allows the second inner housing to be released from the second shield to remove the second inner housing from the cavity of the second outer housing. The second outer housing has second plug keys configured for mating with a second type of plug assembly. The second outer housing has second inner housing keys configured to cooperate with keys of the second inner housing for orienting the second inner housing with respect to the second outer housing.

The first plug keys are oriented at different locations on the first outer housing than a location of the second plug keys on the second outer housing such that the first and second header assemblies are configured to be mated to different types of plug assemblies. The first inner housing keys are oriented at different locations on the first outer housing than a location of the second inner housing keys on the second outer housing such that only the first inner housing is configured to be received in the cavity of the first outer housing and only the second inner housing is configured to be received in the cavity of the second outer housing.

DETAILED DESCRIPTION OF THE INVENTION

Figure 1:
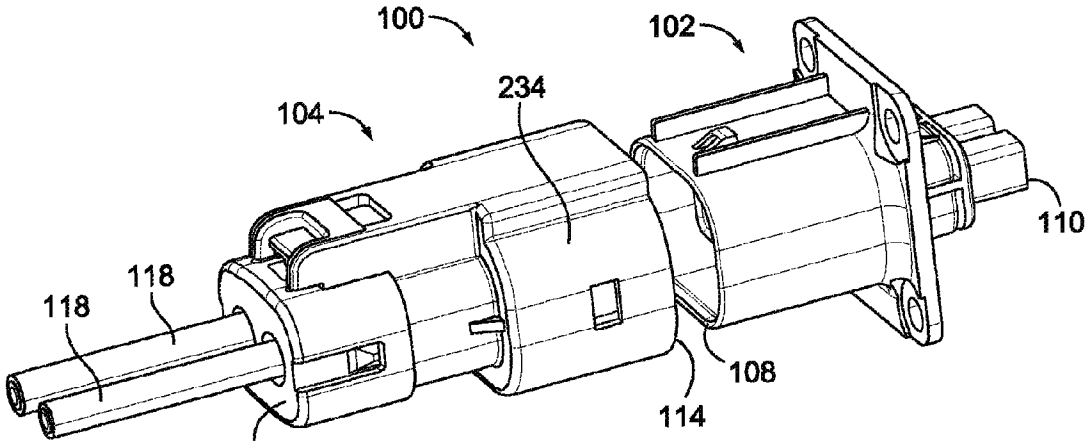
FIG. 1 is a perspective view of a connector system including a header assembly formed in accordance with an exemplary embodiment.

FIG. 1 is a perspective view of a connector system 100 formed in accordance with an exemplary embodiment. The connector system 100 includes a header assembly 102 and a plug assembly 104 that is configured to be mated to the header assembly 102. In an exemplary embodiment, the header assembly 102 is configured to be mounted to a device 106 (shown in FIG. 2).

In an exemplary embodiment, the connector system 100 is used as part of an automotive application, and used to deliver power to and/or from the device 106. The header and plug assemblies 102, 104 may be power connectors for delivering power to and/or from the device 106. Optionally, the header and plug assemblies 102, 104 may be high voltage connectors, such as those typical of electrical or hybrid vehicles. The connector system 100 may be used at high voltage levels, such as above 60 volts. Optionally, the connector system 100 may be used at high voltage levels of approximately 600 volts. The connector system 100 may be used in other types of applications other than automotive applications. The header and plug assemblies 102, 104 may be used to transfer data in addition to, or in alternative to, power.

The header assembly 102 has a mating end 108 and a harness end 110. A harness assembly 112 (shown in FIG. 2) extends from the harness end 110. The plug assembly 104 has a mating end 114 and a cable end 116. One or more cables 118 extend from the cable end 116. During assembly, the mating end 114 of the plug assembly 104 is coupled to the mating end 108 of the header assembly 102.

Figure 2:
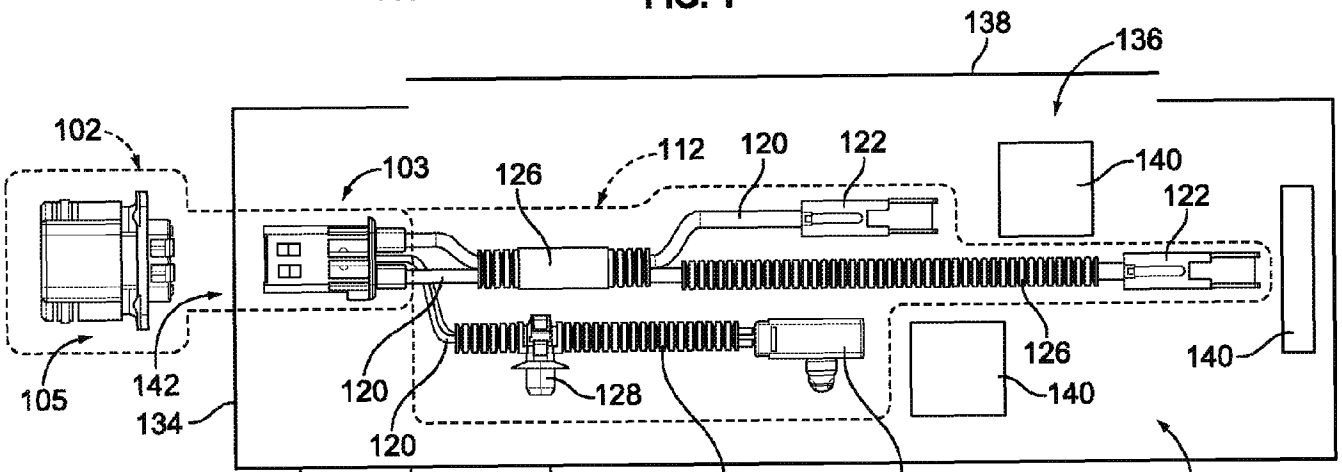
FIG. 2 is a top view of a header assembly in an unassembled state mated to a cable harness assembly and poised for mounting to a device.

FIG. 2 is a top view of the header assembly 102 in an unassembled state showing an inner subassembly 103 and an outer subassembly 105. The inner subassembly 103 is mated to the cable harness assembly 112. The cable harness assembly 112 may form part of the inner subassembly 103. The inner and outer subassemblies 103, 105 are poised for mounting to the device 106.

The harness assembly 112 includes a plurality of wires 120 with connectors 122 terminated to ends of the wires 120. Terminals (not shown) are terminated to opposite ends of the wires 120 and are received within, and secured within, the inner subassembly 103 of the header assembly 102. The terminals may define part of the inner subassembly 103. Jackets 126 may surround the wires 120 to protect the wires 120. Body clips 128 may be coupled to the wires 120 and/or the jackets 126 to secure the wires 120 in place within the device 106. For example, the body clips 128 may be coupled to the walls of the device 106.

The device 106 includes a box or housing 130 defining a chamber 132. The housing 130 may be defined by a plurality of panels 134, such as sheet metal panels, that define the chamber 132. Optionally, at least one of the panels 134 may have an opening 136 that provides access to the chamber 132. Optionally, the opening 136 may be covered by a cover 138. Electrical components 140 (represented schematically in FIG. 2) are received within the device 106. The connectors 122 are coupled to corresponding electrical components 140 to provide power to the electrical components 140.

The device 106 has a mounting hole 142 through one of the panels 134. The mounting hole 142 provides a mounting location for the header assembly 102. In an exemplary embodiment, the header assembly 102 comes in multiple parts that may be plugged together such that the outer subassembly 105 of the header assembly 102 may be mounted to an exterior of the device 106 while the inner subassembly 103 of the header assembly 102 may be loaded through the mounting hole 142 from the interior of the device 106. The inner subassembly 103 of the header assembly 102 may be preassembled to the harness assembly 112 and plugged into the outer subassembly 105 of the header assembly 102 from inside the device 106. As such, the harness assembly 112 does not need to be fed through the mounting hole 142. Rather, the harness assembly 112 and the inner subassembly 103 of the header assembly 102 may be loaded into the device 106 through the opening 136 and aligned with the mounting hole 142 for coupling to the outer subassembly 105 of the header assembly 102.

Figure 3:
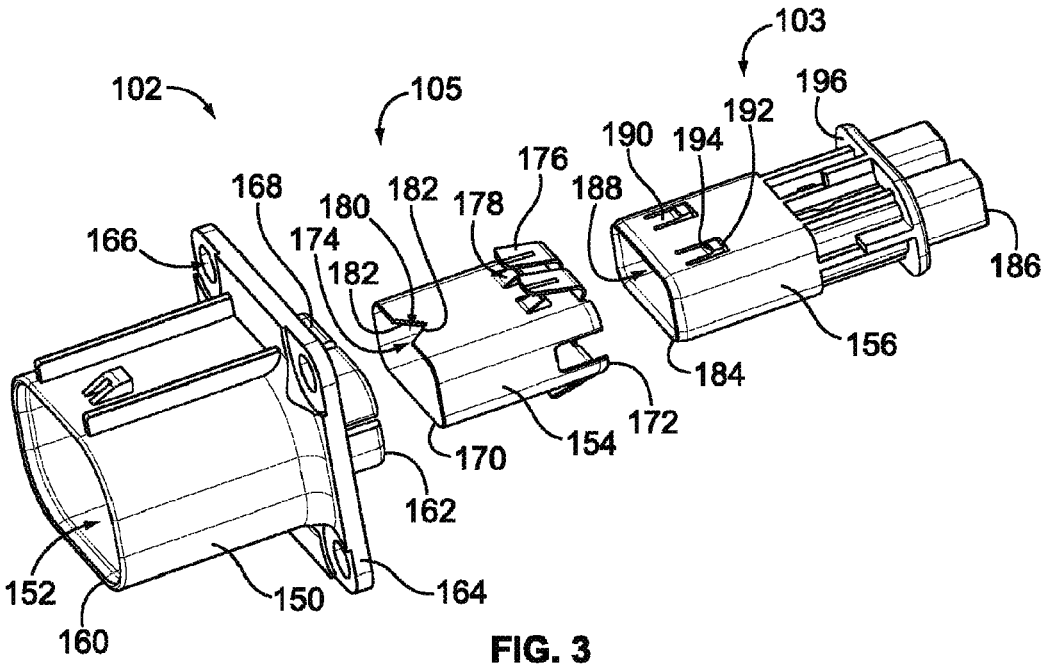
FIG. 3 is an exploded view of the header assembly shown in FIG. 1.

FIG. 3 is an exploded view of the header assembly 102. The header assembly 102 includes an outer housing 150 having a cavity 152, a shield 154 that is configured to be received in the cavity 152 and an inner housing 156 configured to be received within the shield 154 and the cavity 152. The shield 154 is configured to surround at least a portion of the inner housing 156.

In an exemplary embodiment, outer housing 150 and shield 154 define the outer subassembly 105 of the header assembly 102 that is configured to be mounted to the exterior of the device 106 (shown in FIG. 2). The inner housing 156 defines the inner subassembly 103 of the header assembly 102 that is configured to be coupled to the outer housing 150 from inside the device 106. In an alternative embodiment, the shield 154 may define part of the inner subassembly 103 that is configured to be coupled to the outer housing 150 from inside the device 106.

The inner housing 156 is configured to be removably coupled to the shield 154 and outer housing 150. As such, the inner housing 156 may be released from the shield 154 and outer housing 150 such that the inner housing 156 may be pulled back into the device 106 to disassemble the header assembly 102, such as to repair or replace the header assembly 102.

The outer housing 150 has a mating end 160 and a harness end 162. The shield 154 and inner housing 156 are loaded into the cavity 152 through the harness end 162. The cavity 152 is open at the mating end 160 for receiving the plug assembly 104 (shown in FIG. 1). The cavity 152 at the mating end 160 is exposed to an exterior of the device 106 for mating with the plug assembly 104.

The outer housing 150 has a flange 164 proximate to the harness end 162. The flange 164 is used to couple the outer housing 150 to the device 106. For example, the flange 164 may include a plurality of mounting openings 166 for receiving fasteners, such as screws, to secure the flange 164 to the panel 134 (shown in FIG. 2) of the device 106. Optionally, an embossment 168 of the outer housing 150 may extend rearward of the flange 164, such as through the mounting hole 142 (shown in FIG. 2) for mating with the inner housing 156.

The shield 154 extends between a front 170 and a rear 172. The shield 154 has a shield cavity 174 extending between the front 170 and the rear 172. The inner housing 156 is configured to be received in the shield cavity 174. In an exemplary embodiment, the shield 154 is manufactured from a metal material that is stamped and formed into a desired shape. The shield 154 provides electrical shielding around a portion of the inner housing 156. The shield 154 may provide shielding from electromagnetic interference (EMI), or other types of interference. The shield 154 may surround the portion of the inner housing 156 at which the terminals of the harness assembly 112 (shown in FIG. 2) are located and are mated with corresponding terminals of the plug assembly 104.

The shield 154 includes one or more ground fingers 176 extending from the rear 172. The ground fingers 176 are configured to engage the panel 134 (shown in FIG. 2) of the device 106 to electrically common the shield 154 to the panel 134, which may be electrically grounded. The ground fingers 176 constitute spring fingers that are deflectable and may be biased against the panel 134 to ensure contact with the panel 134.

The shield 154 includes one or more tabs 178 proximate to the rear 172. The tabs 178 are used to secure the shield 154 within the outer housing 150. For example, the shield 154 is loaded into the outer housing 150 until the tabs 178 clear a mounting surface (not shown) of the outer housing 150 and snap outward to engage the mounting surface of the outer housing 150 to hold the shield 154 in the cavity 152. The tabs 178 hold the shield 154 from backing out of the cavity 152 and hold the relative position of the shield 154 with respect to the outer housing 150.

In an exemplary embodiment, the shield 154 has a notch 180 at the front 170. The notch 180 is used as an anti-stubbing feature for resisting stubbing during mating with the plug assembly 104. For example, the notch 180 is defined by surfaces 182 that are non-perpendicular with respect to the mating directions of the plug assembly 104. As such, the plug assembly 104 may transition more smoothly across the front 170 of the shield 154.

The inner housing 156 includes a front 184 and a rear 186. The inner housing 156 has an inner cavity 188 with one or more terminal chambers (not shown) that receive terminals of the harness assembly 112. The terminal chambers extend from the rear 186 and open into the inner cavity 188. The inner cavity 188 is provided at the front 184.

The inner housing 156 includes one or more latches 190 provided proximate to the front 184. The latches 190 are used to secure the inner housing 156 within the shield 154. The latches 190 include locking surfaces 192 that are rear facing and are configured to engage the front 170 of the shield 154 when the inner housing 156 is loaded into the shield cavity 174. The latches 190 lock the inner housing 156 in the shield 154, and thus in the outer housing 150 which holds the shield 154. The latches 190 may be actuated or deflected to release the locking surfaces 192 from the front 170 to remove the inner housing 156 from the shield cavity 174. The latches 190 include ramp surfaces 194 that are configured to be actuated to release the latches 190 from the shield 154. The latches 190 may be at least partially deflected into the inner cavity 188 when actuated such that the locking surfaces 192 clear the shield 154 to remove the inner housing 156.

The inner housing 156 includes a flange 196 proximate to the rear 186. The inner housing 156 is configured to be loaded into the shield 154 and outer housing 150 until the flange 196 engages the harness end 162 and/or the shield 154. The flange 196 acts as a stop for loading the inner housing 156 into the outer housing 150.

Figure 4:
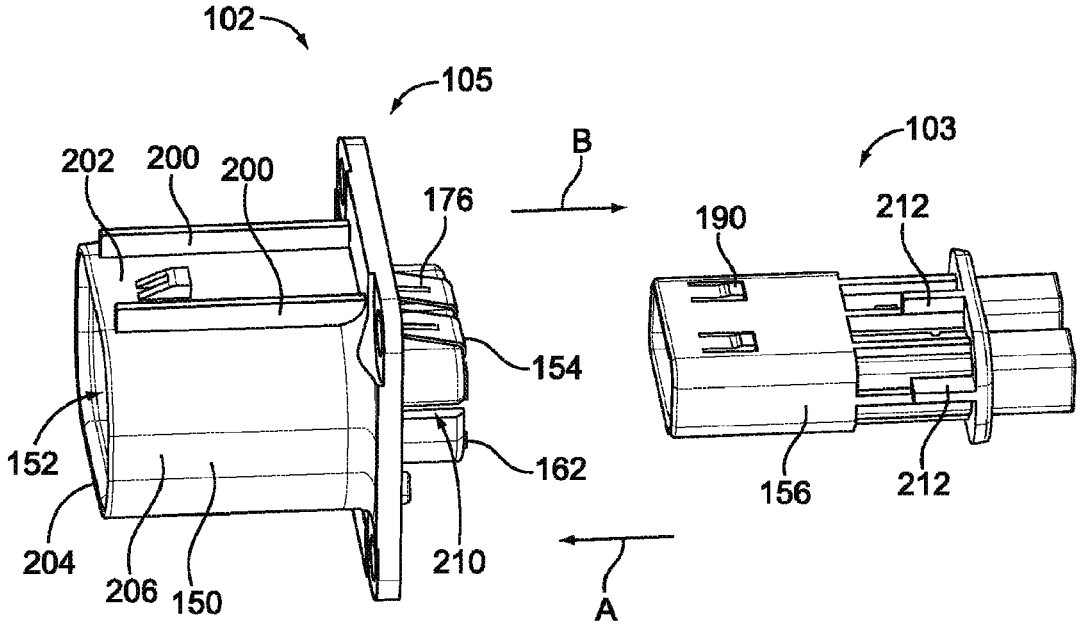
FIG. 4 is a perspective view of the header assembly showing an inner housing subassembly unmated from an outer housing subassembly.

FIG. 4 is a perspective view of the header assembly 102 showing the inner subassembly 103 unmated from the outer subassembly 105. During assembly, the shield 154 is loaded into the cavity 152 through the harness end 162. The shield 154 is secured in the outer housing 150 using the tabs 178 (shown in FIG. 3). The shield 154 and outer housing 150 may be coupled to the device 106 (shown in FIG. 2) independent of the inner housing 156. For example, the outer housing 150 and shield 154 may be coupled to the panel 134 (shown in FIG. 2) through the mounting hole 142 (shown in FIG. 2) from the exterior of the device 106. The ground fingers 176 of the shield 154 extend along the harness end 162 of the outer housing 150 and are configured to engage the mounting hole 142 of the panel 134 when the header assembly 102 is coupled to the device 106. The ground fingers 176 may be deflected outward away from the outer housing 150 such that the ground fingers 176 are spring biased against the panel 134.

The inner housing 156 may be coupled to the shield 154 and outer housing 150 from inside the device 106. The inner housing 156 is loaded into the cavity 152 through the harness end 162, such as in a loading direction, shown by arrow A. The latches 190 are used to secure the inner housing 156 to the shield 154. The inner housing 156 may be removed from the outer housing 150 in an unloading direction, shown by arrow B. During removal, the latches 190 are actuated and pressed inward until the locking surfaces 192 clear the shield 154 to allow the inner housing 156 to be removed.

In an alternative embodiment, rather than coupling the inner housing 156 from inside the device 106, the header assembly 102 may be preassembled with the inner housing 156 coupled to the shield 154 and outer housing 150 prior to the header assembly 102 being coupled to the device 106. The entire header assembly 102 may be coupled to the device 106 from the exterior of the device 106. Optionally, the harness assembly 102 may be preassembled to the header assembly 102 prior to coupling the header assembly 102 to the device 106. The harness assembly 112 and header assembly 102 are loaded through the mounting hole 142 from outside the device 106 until the outer housing 150 and shield 154 are coupled to the panel 134.

In an exemplary embodiment, the header assembly 102 is configured to be mated with a particular type of plug assembly 104. For example, the header assembly 102 may be associated with a particular electrical component(s) within the device 106 that requires mating with a particular type of plug assembly 104, such as a plug assembly 104 having a particular arrangement of terminals (e.g., positioning and/or type of terminals). In order to avoid having the wrong type of plug assembly 104 mated to the header assembly 102, the header assembly 102 includes plug keys 200 that define a predetermined mating interface that only allows one type of plug assembly 104 to be mated to the header assembly 102.

In the illustrated embodiment, the plug keys 200 are ribs or protrusions extending from the outer housing 150. Other types of plug keys 200 may be used in alternative embodiments, such as channels, tabs, or other polarizing features. The type of plug keys 200 used, as well as the size of the plug keys 200 and/or positioning of the plug keys 200, defines the predetermined mating interface. In the illustrated embodiment, the header assembly 102 has two plug keys 200 extending from a top 202 of the outer housing 150. An alternative header assembly 102 may have plug keys 200 in different positions, such as along a bottom 204 and/or side 206 of the outer housing 150 to define a different mating interface.

A family of header assemblies 102 may be provided, each having a different mating interface for mating with a different type of plug assembly 104. Each header assembly 102 within the family may be associated with a different electrical component(s) 140 within the device 106. Optionally, different header assemblies 102 of the family may be used within the same device 106 for powering different electrical components 140 within the device 106. The different arrangement of Plug keys 200 on the different header assemblies 102 ensure that the proper plug assemblies 104 are mated to the header assemblies 102.

In an exemplary embodiment, the different header assemblies 102 within the family are used with different harness assemblies 112, such as harness assemblies 112 that have a different number of connectors, a different number of wires and/or a different number or type of terminals. In order to avoid having the wrong harness assembly 112 coupled with a particular header assembly 102, the family of header assemblies 102 may include different inner housings 156, with each inner housing 156 of the family being associated with a different harness assembly 112. In order to avoid plugging the wrong inner housing 156 into a particular outer housing 150, the inner housing 156 and outer housing 150 are keyed or polarized.

The outer housing 150 includes one or more inner housing keys 210. The inner housing 156 includes one or more keys 212 that correspond with the inner housing keys 210 of the outer housing 150. The keys 212 interact with the inner housing keys 210 to orient the inner housing 156 with respect to the outer housing 150 and ensure that the proper inner housing 156 is mated with the particular outer housing 150. In the illustrated embodiment, the inner housing keys 210 are defined by channels in the outer housing 150 and the keys 212 are defined by tabs extending from the inner housing 156. The number, positioning, size and/or type of inner housing keys 210 and keys 212 may be changed on different types of inner housings 156 and outer housings 150 of the different family members of headers assemblies 102.

Figure 5:
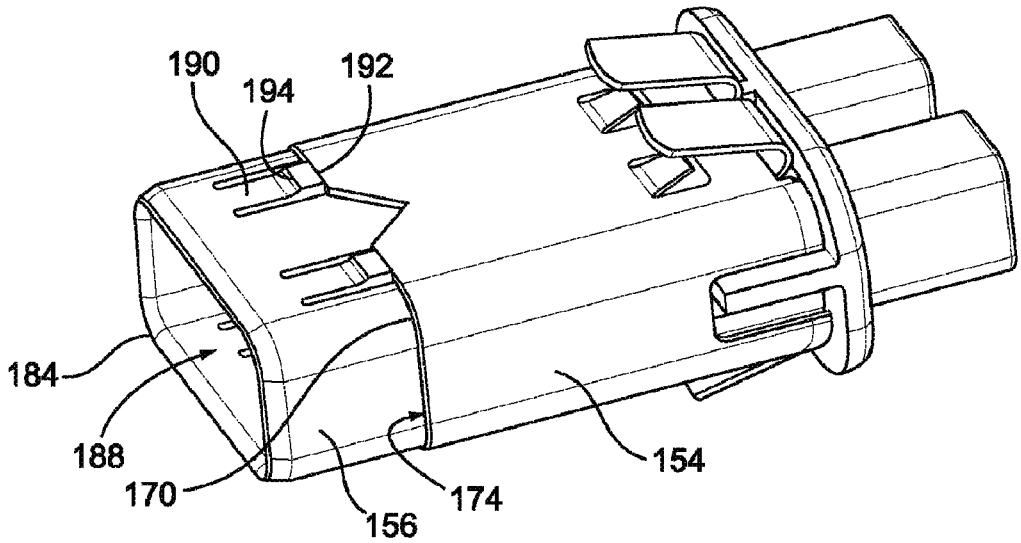
FIG. 5 is a front perspective view of the inner housing subassembly coupled to a shield.

FIG. 5 is a front perspective view of a portion of the header assembly 102 showing the inner housing 156 coupled to the shield 154. The outer housing 150 (shown in FIG. 3) has been removed for clarity. When assembled, the inner housing 156 is loaded into the shield cavity 174. The latches 190 engage the front 170 of the shield 154 to secure the inner housing 156 to the shield 154. The locking surfaces 192 engage the front 170. To remove the inner housing 156 from the shield 154, the latches 190 are pressed inward into the inner cavity 188 until the locking surfaces 192 clear the shield 154, allowing the inner housing 156 to be pulled rearward out of the shield 154. The ramp surfaces 194 define surfaces of the latches 190 that may be engaged by a tool to actuate the latches 190 to an unlatched state. Optionally, a tool may be provided that simultaneously unlatches all of the latches 190.

The latches 190 are positioned forward of the front 170 of the shield 154. The front 184 of the inner housing 156 extends beyond the front 170 of the shield 154 such that the latches 190 are configured to be positioned between the front 170 of the shield 154 and the front 184 of the inner housing 156.

In an exemplary embodiment, and as described in further detail below, the plug assembly 104 (shown in FIG. 1) is used to block inadvertent actuation of the latches 190 so that the inner housing 156 is not inadvertently released from the shield 154. When the plug assembly 104 is mated to the header assembly 102, the plug assembly 104 is in a blocking position and the inner housing 156 cannot be inadvertently released from the shield 154.

Figure 6:
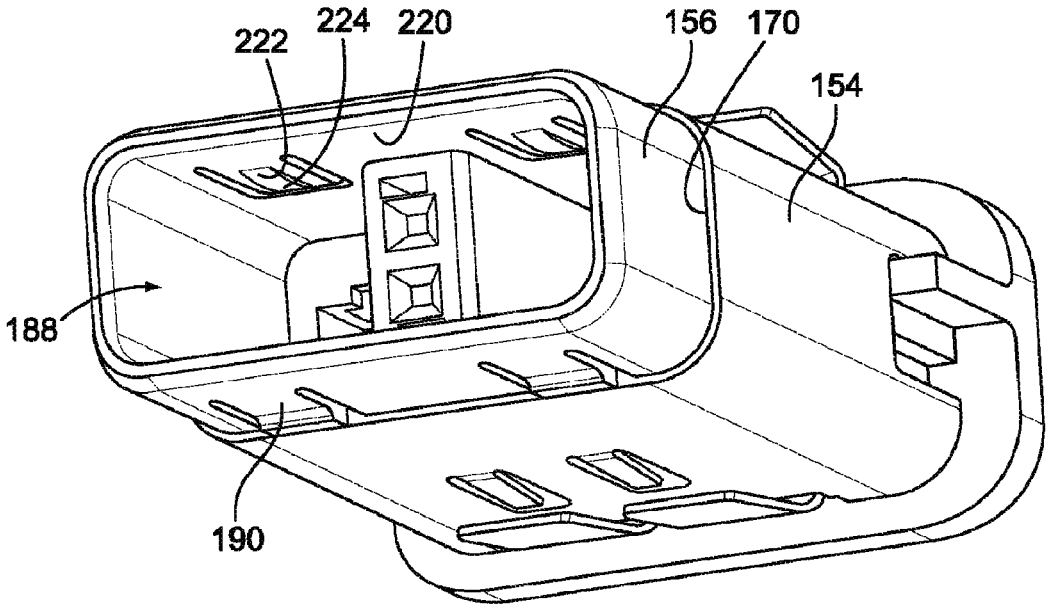
FIG. 6 is a front perspective end view of the inner housing and the shield shown in FIG. 5.

FIG. 6 is a front perspective view of a portion of the header assembly 102 showing the inner housing 156 and the shield 154. The inner cavity 188 is shown in FIG. 6. The inner cavity 188 is defined by inner cavity walls 220. The latches 190 have inner surfaces 222 that are generally aligned with the inner cavity walls 220. To release the inner housing 156 from the shield 154, the latches 190 are pressed into the inner cavity 188 such that portions of the latches 190 extend below the inner cavity walls 220. The inner cavity 188 provides a space for the latches 190 to be pressed inward to clear the front 170 of the shield 154.

In an exemplary embodiment, the inner surfaces 222 of the latches 190 have protrusions 224 extending inward therefrom. The protrusions 224 define surfaces of the latches 190 that are configured to engage the plug assembly 104 (shown in FIG. 1) when the plug assembly 104 is mated with the header assembly 102. Such engagement between the protrusions 224 and the plug assembly 104 hold the latches 190 in the locked position in engagement with the shield 154.

Figure 7:
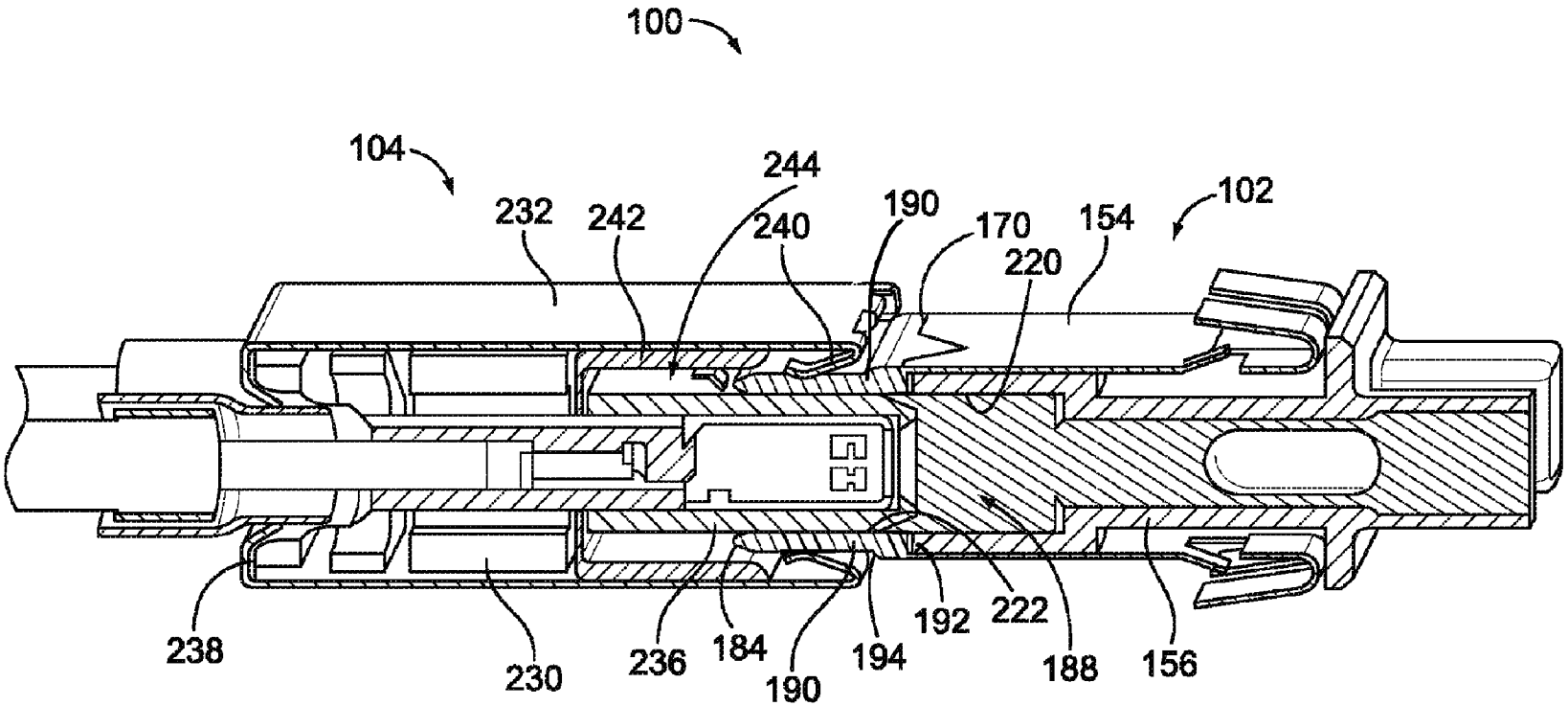
FIG. 7 is a cross-sectional view of the connector assembly of FIG. 1 including the header assembly.

FIG. 7 is a cross-sectional view of a portion of the connector assembly 100 including the header assembly 102 and a portion of the plug assembly 104. FIG. 7 shows the inner housing 156 and the shield 154, but the outer housing 150 (shown in FIG. 3) is removed for clarity. The plug assembly 104 includes an inner housing 230 and a shield 232 surrounding a portion of the inner housing 230. The plug assembly 104 also includes an outer housing 234 (shown in FIG. 1) that has been removed for clarity. The inner housing 230 has a plug end 236 and a cable end 238. The plug end 236 is configured to be received in the inner cavity 188 of the inner housing 156. When mated, the shield 232 of the plug assembly 104 engages the shield 154 of the header assembly 102 to electrically common the shields 232, 154.

In an exemplary embodiment, the shield 232 has shield fingers 240 that engage the shield 154 of the header assembly 102 to electrically connect the shield 232 of the plug assembly 104 and the shield 154 of the header assembly 102. The shield fingers 240 are configured to be biased against the shield 154 to ensure electrical connection therebetween. FIG. 7 shows the plug assembly 104 in a partially mated state. In the fully mated state, the shield fingers 240 are positioned outward of and engage the shield 154.

In an exemplary embodiment, the inner housing 230 includes a shroud 242 surrounding a portion of the plug end 236. A channel 244 is defined between the shroud 242 and the plug end 236. In the fully mated state, the front 184 of the inner housing 156 is configured to be received in the channel 244 such that the plug end 236 is interior of the inner housing 156 and the shroud 242 is positioned outward of the inner housing 156.

When the plug end 236 is loaded into the inner cavity 188, the walls defining the plug end 236 extend along the inner cavity walls 220 and the inner surfaces 222 of the latches 190. The plug end 236 is positioned in a blocking position with respect to the latches 190. The plug end 236 blocks actuation of the latches 190 such that the latches 190 are held in the locked positions in front of the shield 154. The latches 190 cannot be actuated inward, and thus the inner housing 156 cannot be released from the shield 154 when the plug assembly 104 is mated to the header assembly 102.

The ramp surfaces 194 of the latches 190 are aligned with the shield fingers 240 such that as the plug assembly 104 is loaded into the header assembly 102, the shield fingers 240 ride along the ramp surfaces 194. The ramp surfaces 194 force the shield fingers 240 outward until the shield fingers 240 clear the front 170 of the shield 154. Forcing the shield fingers 240 outward prevents stubbing of the shield fingers 240 on the shield 154. Lifting the shield fingers 240 over the front of the shield 154 may also prevent scraping of the shield fingers 240 along the shield 154.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A header assembly comprising:

an outer housing having a mating end and a harness end, the outer housing having a cavity at the mating end, the outer housing having a flange configured to be mounted to a panel of a device, the outer housing being configured to be exposed to an exterior of the device for mating with a plug assembly;

a shield received in the cavity, the shield having a front and a rear; and an inner housing received in the cavity with the shield surrounding at least a portion of the inner housing, the inner housing having a front and a rear, the inner housing having a latch engaging the front of the shield, the latch allowing the inner housing to be released from the shield to remove the inner housing from the cavity.

2. The header assembly of claim 1, wherein the latch includes a locking surface engaging the front of the shield, the locking surface being rear facing.

3. The header assembly of claim 1, wherein the latch includes a ramp surface that is configured to be actuated to release the latch from the shield.

4. The header assembly of claim 1, wherein the front of the inner housing extends beyond the front of the shield with the latch positioned between the front of the shield and the front of the housing.

5. The header assembly of claim 1, wherein the shield is coupled to the outer housing to secure the shield to the outer housing.

6. The header assembly of claim 1, further comprising a harness assembly coupled to the inner housing and extending from the harness end of the outer housing, the harness assembly and inner housing being separable from the outer housing and shield by the latch.

7. The header assembly of claim 1, wherein the outer housing includes plug keys configured to be positioned at different locations to define different types of header assemblies configured for mating with different types of plug assemblies, and wherein the outer housing includes inner housing keys configured to be positioned at different locations to define different types of header assemblies configured for mating with different types of inner housings.

8. The header assembly of claim 1, wherein the outer housing includes inner housing keys configured to be positioned at different locations, the inner housing having keys configured to be positioned at different locations, the keys engaging the inner housing keys of the corresponding type of outer housing, wherein the keys only allow the inner housing to be received in the correct type of outer housing.

9. A connector system comprising:

a header assembly comprising an outer housing having a cavity, a shield received in the cavity and an inner housing received in the cavity with the shield surrounding at least a portion of the inner housing, the outer housing having a mating end and a harness end, the shield having a front and a rear, the inner housing having a front and a rear, the inner housing having an inner cavity at the front of the inner housing, the inner housing having a latch engaging the front of the shield, the latch allowing the inner housing to be released from the shield to remove the inner housing from the cavity; and a plug assembly received in the cavity of the outer housing, the plug assembly having a plug end received in the inner housing, the plug end blocking actuation of the latch when received in the inner cavity.

10. The connector system of claim 9, wherein the plug end has an outer surface, the outer surface engaging inner cavity walls of the inner cavity and engaging an inner surface of the latch to block actuation of the latch.

11. The connector system of claim 9, wherein the plug assembly includes a shield having a finger, the finger engaging the shield of the header assembly to electrically connect the shield of the plug assembly and the shield of the header assembly, the finger being deflected by the latch to clear the front of the shield of the header assembly.

12. The connector system of claim 9, wherein the latch includes a locking surface engaging the front of the shield, the locking surface being rear facing.

13. The connector system of claim 9, wherein the latch includes a ramp surface that is configured to be actuated to release the latch from the shield when the plug assembly is removed from a blocking position in the inner cavity.

14. The connector system of claim 9, wherein the shield is coupled to the outer housing to secure the shield to the outer housing.

15. The connector system of claim 9, further comprising a harness assembly coupled to the inner housing and extending from the harness end of the outer housing, the harness assembly and inner housing being separable from the outer housing and shield by the latch.

16. The header assembly of claim 9, wherein the outer housing includes plug keys configured to be positioned at different locations to define different types of header assemblies for mating with different types of plug assemblies, and wherein the outer housing includes inner housing keys configured to be positioned at different locations to define different types of header assemblies configured for mating with different types of inner housings.

17. The header assembly of claim 9, wherein the outer housing includes inner housing keys configured to be positioned at different locations, the inner housing having keys configured to be positioned at different locations, the keys engaging the inner housing keys of the corresponding type of outer housing, wherein the keys only allow the inner housing to be received in the correct type of outer housing.

18. A family of header assemblies comprising:

a first header assembly comprising a first outer housing having a cavity, a first shield received in the cavity and a first inner housing received in the cavity with the first shield surrounding at least a portion of the first inner housing, the first inner housing having a latch engaging a front of the first shield, the latch allowing the first inner housing to be released from the first shield to remove the first inner housing from the cavity of the first outer housing, the first outer housing having first plug keys configured for mating with a first type of plug assembly, and the first outer housing having first inner housing keys configured to cooperate with keys of the first inner housing for orienting the first inner housing with respect to the first outer housing; and a second header assembly comprising a second outer housing having a cavity, a second shield received in the cavity of the second outer housing and a second inner housing received in the cavity of the second outer housing with the second shield surrounding at least a portion of the second inner housing, the second inner housing having a latch engaging a front of the second shield, the latch allowing the second inner housing to be released from the second shield to remove the second inner housing from the cavity of the second outer housing, the second outer housing having second plug keys configured for mating with a second type of plug assembly, and the second outer housing having second inner housing keys configured to cooperate with keys of the second inner housing for orienting the second inner housing with respect to the second outer housing;

wherein the first plug keys are oriented at different locations on the first outer housing than a location of the second plug keys on the second outer housing such that the first and second header assemblies are configured to be mated to different types of plug assemblies; and wherein the first inner housing keys are oriented at different locations on the first outer housing than a location of the second inner housing keys on the second outer housing such that only the first inner housing is configured to be received in the cavity of the first outer housing and only the second inner housing is configured to be received in the cavity of the second outer housing.

19. The family of header assemblies of claim 18, wherein the second inner housing keys block the keys of the first inner housing such that the first inner housing is unable to be loaded into the second outer housing.

20. The family of header assemblies of claim 18, wherein the first inner housing keys correspond with the keys of the first inner housing such that the first inner housing is configured to be mated only with the plug assembly capable of being mated with the first outer housing.

21. A header assembly for mounting to a device, the header assembly comprising:

an outer housing having a mating end and a harness end, the outer housing having a cavity at the mating end, the outer housing being configured to be exposed to an exterior of the device for mating with a plug assembly;

a shield received in the cavity, the shield having a front and a rear; and an inner housing received in the cavity with the shield surrounding at least a portion of the inner housing, the inner housing having a front and a rear, the inner housing having an inner cavity that is configured to receive a terminal of a header assembly, the inner housing having a plurality of latches proximate to the front of the inner housing, the latches engaging at least one of the shield or the outer housing of the header assembly, the latches allowing the inner housing to be removably coupled to the shield or the outer housing;

wherein the inner housing is mated to the shield or the outer housing from inside the device when the outer housing is coupled to the device from outside of the device.

* * * * *